US010996619B2

(12) United States Patent
Nguyen

(10) Patent No.: US 10,996,619 B2
(45) Date of Patent: May 4, 2021

(54) IMAGE FORMING APPARATUS

(71) Applicant: KYOCERA Document Solutions Inc., Osaka (JP)

(72) Inventor: Danh Chien Nguyen, Osaka (JP)

(73) Assignee: KYOCERA Document Solutions Inc.

( * ) Notice: Subject to any disclaimer, the term of this patent is extended or adjusted under 35 U.S.C. 154(b) by 0 days.

(21) Appl. No.: 16/827,490

(22) Filed: Mar. 23, 2020

(65) Prior Publication Data

US 2020/0310337 A1 Oct. 1, 2020

(30) Foreign Application Priority Data

Mar. 26, 2019 (JP) ..... JP2019-059126

(51) Int. Cl.
*G03G 21/16* (2006.01)
*G03G 15/04* (2006.01)

(52) U.S. Cl.
CPC ... *G03G 21/1666* (2013.01); *G03G 15/04072* (2013.01); *G03G 21/1633* (2013.01)

(58) Field of Classification Search
CPC ..... G03G 15/04036; G03G 21/1666; G03G 15/04054; G03G 15/0435; G03G 21/1647
See application file for complete search history.

(56) References Cited

U.S. PATENT DOCUMENTS

2011/0115870 A1* 5/2011 Nakaie ..... B41J 2/473 347/224
2014/0003833 A1* 1/2014 Asakawa ..... G03G 21/206 399/92
2015/0346678 A1* 12/2015 Fukuda ..... G03G 21/1633 399/110
2018/0181053 A1* 6/2018 Nguyen ..... G03G 21/1633

FOREIGN PATENT DOCUMENTS

JP 2006-119457 5/2006

* cited by examiner

*Primary Examiner* — Walter L Lindsay, Jr.
*Assistant Examiner* — Jessica L Eley
(74) *Attorney, Agent, or Firm* — Gerald E. Hespos; Michael J. Porco; Matthew T. Hespos

(57) ABSTRACT

An image forming apparatus includes an apparatus body, an image forming unit, a covering member, and a light emitting unit. The apparatus body has an opening through which an internal space is exposed. The image forming unit includes an image carrier to form an image on a sheet. The covering member has a closing face capable of closing the opening of the apparatus body from above. The covering member is pivotally supported on the apparatus body to pivot between a close position where the closing face closes the internal space and an open position where a portion of the image forming unit is exposed to the outside. The light emitting unit is attached to the closing face, and emits a light to the circumferential surface of the image carrier to form the electrostatic latent image in a state where the covering member is at the close position.

4 Claims, 24 Drawing Sheets

ENLARGED VIEW OF A3

ENLARGED VIEW OF A4

ENLARGED VIEW OF A5

IMAGE FORMING APPARATUS

INCORPORATION BY REFERENCE

This application is based on Japanese Patent Application No. 2019-59126 filed on Mar. 26, 2019 to the Japan Patent Office, the contents of which are incorporated by reference.

BACKGROUND

Field of the Invention

The present disclosure relates to an image forming apparatus including a light emitting unit.

Related Art

A conventional image forming apparatus for forming an image on a sheet is known that includes an image forming unit including an image carrier, and a light emitting unit that emits light (laser beam) to the image carrier. This type of an image forming apparatus forms an electrostatic latent image on the image carrier by emitting a laser beam from the light emitting unit. The image forming unit forms an image on a sheet, the image corresponding to the electrostatic latent image formed on the image carrier.

The image forming apparatus includes an openable cover attached to an apparatus body that houses the image forming unit and the light emitting unit. The cover is opened when replacing, for example, the image forming unit or removing a jammed sheet (jam-fixing). In the conventional image forming apparatus, the image forming unit is assembled in the apparatus body and the light emitting unit is assembled near the light emitting unit.

SUMMARY

An image forming apparatus according to one aspect of the present disclosure includes an apparatus body, an image forming unit, a covering member, and a light emitting unit. The apparatus body has an internal space, and an opening through which the internal space is exposed. The image forming unit is disposed in the internal space. The image forming unit includes an image carrier having a circumferential surface on which an electrostatic latent image is carried. The image forming unit forms an image on a sheet, the image corresponding to the electrostatic latent image. The covering member has a closing face capable of closing the opening of the apparatus body from above. The covering member is pivotally supported on the apparatus body to pivot between a close position where the closing face closes the internal space and an open position where a portion of the image forming unit is exposed to the outside. The light emitting unit is attached to the closing face of the covering member. The light emitting unit emits a light to the circumferential surface of the image carrier to form the electrostatic latent image on the circumferential surface in a state where the covering member is at the close position.

DETAILED DESCRIPTION

An image forming apparatus according to one embodiment of the present disclosure will now be described with reference to the drawings. Terms used for indicating directions in the following description, such as "up", "down", "front", "rear", "left", and "right", are used by means of simply clarifying the description, not by means of limiting the mechanism of the image forming apparatus. In the following description, the term "sheet" means a sheet material, such as a copying paper, a coated paper, an OHP sheet, a cardboard, a postcard, a tracing paper, a sheet material subjected to image forming processing, and a sheet material subjected to any processing other than image forming processing.

Figure 1:
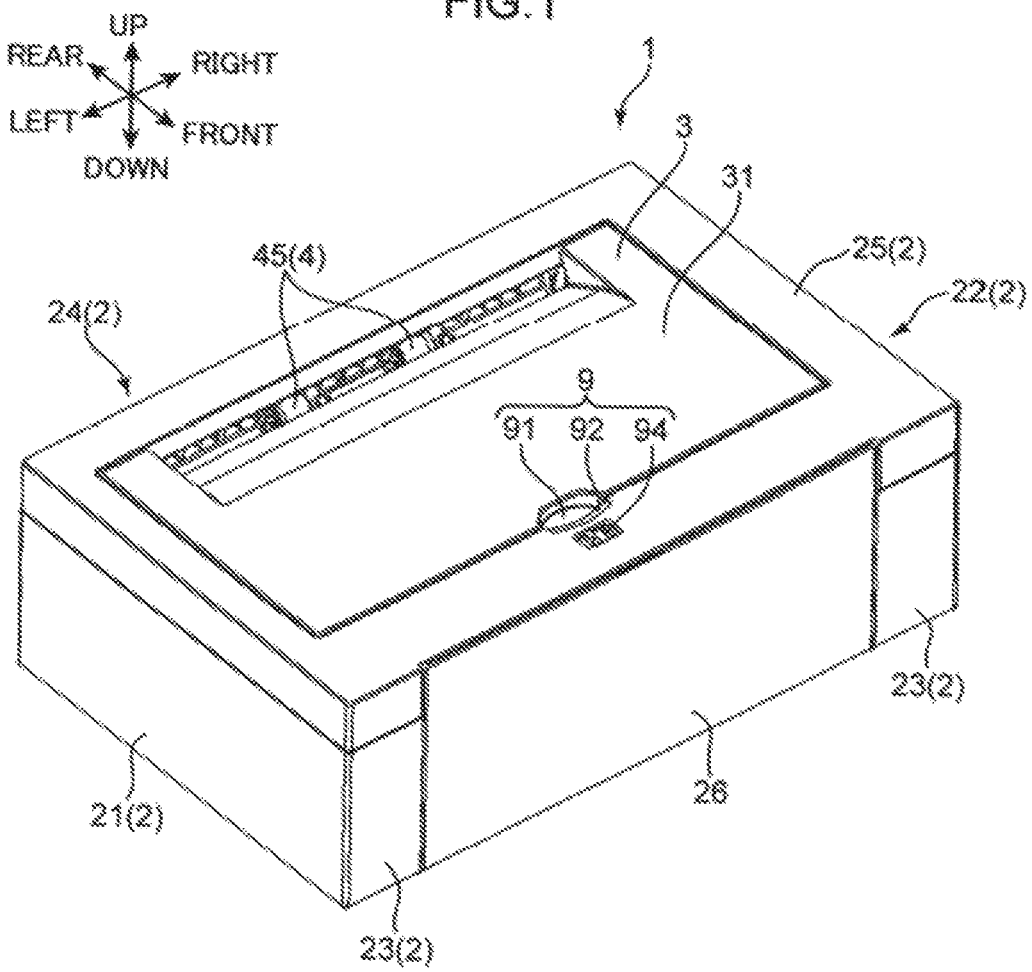
FIG. 1 is a perspective view illustrating an external appearance of an image forming apparatus according to one embodiment of the present disclosure.
Figure 2:
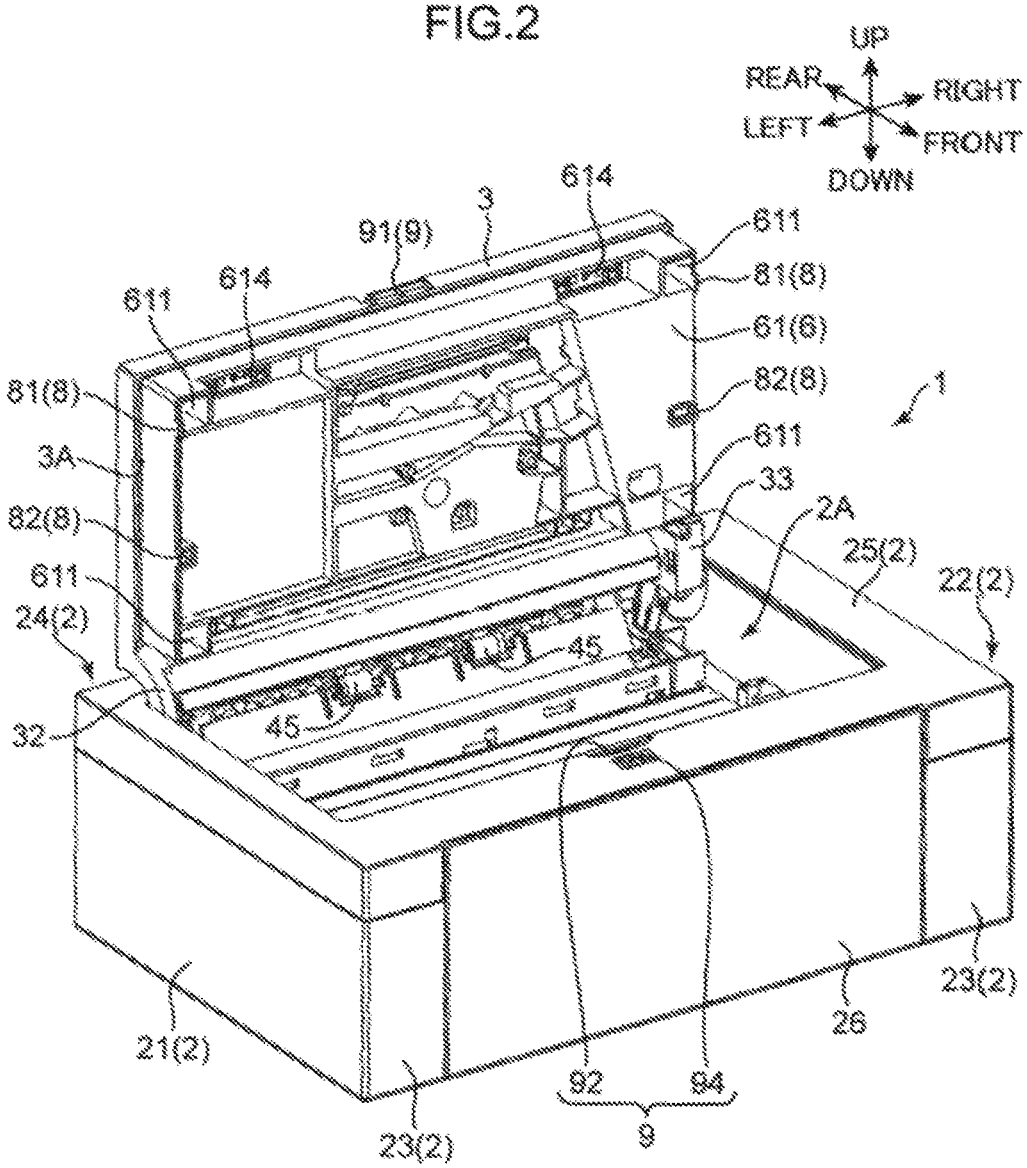
FIG. 2 is a perspective view illustrating a covering member of the image forming apparatus at an open position.
Figure 3:
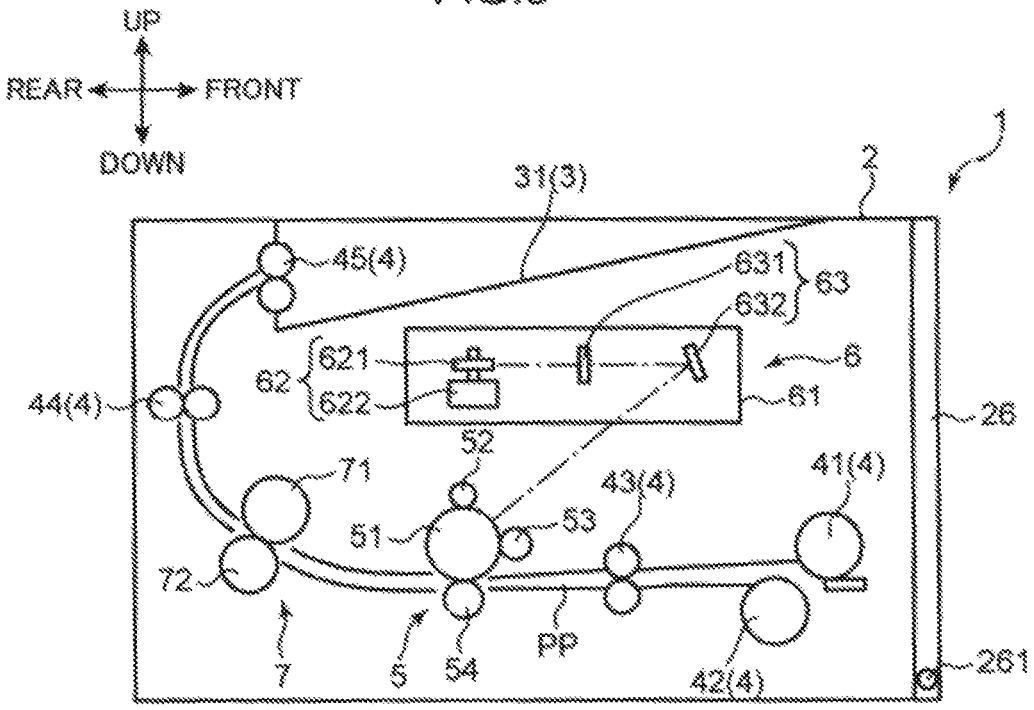
FIG. 3 schematically illustrates an internal structure of the image forming apparatus.

FIG. 1 is a perspective view illustrating an external appearance of an image forming apparatus 1 according to one embodiment of the present disclosure. FIG. 2 is a perspective view illustrating a covering member 3 of the image forming apparatus 1 at an open position. FIG. 3 schematically illustrates an internal structure of the image forming apparatus 1. The image forming apparatus 1 illustrated in FIGS. 1 to 3 is a black and white printer. For other embodiments, the image forming apparatus 1 may be a color printer, a copier, a fax machine, a multifunction machine having functions including that of a color printer, a copier, and a fax machine, or an apparatus for forming a toner image on a sheet.

[General Configuration of Image Forming Apparatus]

The image forming apparatus 1 includes an apparatus body 2 having an internal space 2A. The apparatus body 2 is formed in an approximately rectangular shape and has an opening on a top face through which the internal space 2A is exposed. The apparatus body 2 includes a first side wall 21, a second side wall 22, a front wall 23, a rear wall 24, and a top cover 25. The first side wall 21 defines a left side face of the apparatus body 2. The second side wall 22 is separated from the first side wall 21 along the right-and-left direction and defines a right side wall of the apparatus body 2. The front wall 23 joins a front end portion of the first side wall 21 as well as a front end portion of the second side wall 22. An opening is provided in a middle portion, regarding the right-and-left direction, of the front wall 23. The rear wall 24 is provided between and joins rear end portions of the first side wall 21 and the second side wall 22. The top cover 25 has a form of a rectangular frame and joins top end portions of the first side wall 21, the second side wall 22, the front wall 23, and the rear wall 24.

In the internal space 2A of the apparatus body 2, a sheet conveyance path PP is provided to convey a sheet in a predetermined conveyance direction. A manual-feed tray 26 is attached to the opening provided in the middle portion, regarding the right-and-left direction, of the front wall 23. The manual-feed tray 26 has a pivot shaft 261 in a bottom end and can pivot upward and downward about the pivot shaft 261 serving as a pivot point.

As illustrated in FIG. 3, the image forming apparatus 1 includes a sheet conveyance unit 4, an image forming unit 5, a light emitting unit 6, and a fixing unit 7.

The sheet conveyance unit 4, disposed in the internal space 2A of the apparatus body 2, is a mechanism for conveying a sheet from the manual-feed tray 26, via the image forming unit 5 and the fixing unit 7, to a discharge part 31, which is a top face of a covering member 3 described later. The sheet conveyance unit 4 includes a feed roller 41, a conveyance roller 42, a registration roller pair 43, a conveyance roller pair 44, and a discharge roller pair 45. The feed roller 41, the conveyance roller 42, and the registration roller pair 43 are disposed in an upstream, regarding the sheet conveyance direction, of the image forming unit 5. The conveyance roller pair 44 and the discharge roller pair 45 are disposed in a downstream, regarding the sheet conveyance direction, of the fixing unit 7.

The feed roller 41 is disposed further inside (to the rear side) than the pivot shaft 261 of the manual-feed tray 26 and pulls in a sheet from the manual-feed tray 26 to the inside of the apparatus body 2. The conveyance roller 42 is disposed in the downstream, regarding the sheet conveyance direction, of the feed roller 41. The conveyance roller 42 conveys the sheet fed by the feed roller 41 further to the downstream. The registration roller pair 43 has a function of straightening a sheet that has been conveyed diagonally. The position of an image formed on the sheet is thus adjusted. The registration roller pair 43 sends a sheet to the image forming unit 5 at a timing when the image forming unit 5 forms an image. A sheet subjected to fixing processing by the fixing unit 7 is conveyed to the upper side by the conveyance roller pair 44 and eventually discharged out of the apparatus body 2 by the discharge roller pair 45. The sheet discharged out of the apparatus body 2 is stacked on the discharge part 31.

The image forming unit 5 is a unit that forms an image on a sheet and is disposed in the internal space 2A of the apparatus body 2. The image forming unit 5 is detachably attached to the apparatus body 2. The image forming unit 5 includes a photoreceptor drum 51 (image carrier), a charging unit 52, a developing unit 53, and a transferring unit 54. The photoreceptor drum 51 has a cylindrical shape extending in the right-and-left direction and is rotatable about an axis. The photoreceptor drum 51 has a circumferential surface on which an electrostatic latent image is formed, and the circumferential surface carries a toner image corresponding to the electrostatic latent image. The charging unit 52 is charged by a predetermined voltage to charge the circumferential surface of the photoreceptor drum 51 in an approximately uniform manner. The developing unit 53 supplies toner to the circumferential surface of the photoreceptor drum 51 on which the electrostatic latent image is formed. By the developing unit 53 supplying the toner to the photoreceptor drum 51, the electrostatic latent image formed on the circumferential surface of the photoreceptor drum 51 is developed (becomes visible). As a result, the toner image is formed on the circumferential surface of the photoreceptor drum 51. The transferring unit 54 is disposed below the photoreceptor drum 51 to oppose the photoreceptor drum 51 with the sheet conveyance path PP therebetween. A transfer nip is formed between the transferring unit 54 and the photoreceptor drum 51, and the transferring unit 54 transfers the toner image to a sheet.

The fixing unit 7 is disposed in the downstream, regarding the sheet conveyance direction, of the image forming unit 5 and fixes the toner image on the sheet. The fixing unit 7 includes a heat roller 71 that melts the toner on the sheet, and a press roller 72 that makes the sheet tightly contact the heat roller 71.

The light emitting unit 6 emits a laser beam to the circumferential surface of the photoreceptor drum 51 charged by the charging unit 52, and thereby forms the electrostatic latent image on the circumferential surface. The light emitting unit 6 scans the circumferential surface of the photoreceptor drum 51 with the laser beam along a main-scan direction to form an electrostatic latent image on the circumferential surface. The main-scan direction of scanning the photoreceptor drum 51 by the light emitting unit 6 is the right-and-left direction, which is an axial direction of the photoreceptor drum 51.

The light emitting unit 6 includes an optical housing 61, a light deflector 62, and an imaging optical system 63, the light deflector 62 and the imaging optical system 63 being housed in the optical housing 61. The light deflector 62 reflects, and thereby deflects, the laser beam from a light incidence system (not shown) to perform scanning. The light deflector 62 includes a polygon mirror 621 and a polygon motor 622. The polygon mirror 621 is a multi-face mirror having a plurality of deflection faces. The polygon mirror 621 is rotated by a driving force of the polygon motor 622 and reflects, and thereby deflects, the laser beam incident on the deflection face to perform scanning. The circumferential surface of the photoreceptor drum 51 is scanned along the main-scan direction using the laser beam deflected by the polygon mirror 621. The imaging optical system 63 uses the laser beam deflected by the polygon mirror 621 to scan the circumferential surface of the photoreceptor drum 51, thereby forming an image on the circumferential surface. The imaging optical system 63 includes a scan lens 631 and a reflection mirror 632. The scan lens 631 is disposed in the optical housing 61 to oppose the deflection face of the polygon mirror 621. The scan lens 631 concentrates the laser beam reflected by the deflection face of the polygon mirror 621. The reflection mirror 632 reflects the laser beam, which has passed through the scan lens 631, at a location on an imaging light path of the laser beam, and thereby an image is formed on the circumferential surface of the photoreceptor drum 51.

The light emitting unit 6 is attached not to the apparatus body 2 but to the covering member 3 as illustrated in FIG. 2. Detail on a structure by which the light emitting unit 6 is attached to the covering member 3 will be described later.

The image forming apparatus 1 includes the covering member 3 which is openable and attached to the apparatus body 2. The covering member 3 includes a rectangular closing face 3A capable of closing a top opening of the apparatus body 2 from above, that is, capable of closing the internal space 2A of the apparatus body 2 from above. The covering member 3 is pivotally supported on the apparatus body 2 to pivot between a close position where the closing face 3A closes the internal space 2A and an open position where a portion of the image forming unit 5 is exposed to the outside.

The covering member 3 includes a first arm 32 and a second arm 33 which serve as a pivot point about which the covering member 3 pivots between the close position and the open position. The first arm 32 is provided at a left rear end of the covering member 3 and supported at an upper rear end of the first side wall 21. The second arm 33 is provided at a right rear end of the covering member 3 and supported at an upper rear end of the second side wall 22. FIG. 1 illustrates the covering member 3 at the close position. FIG. 2 illustrates the covering member 3 at the open position.

The top face, in the opposite side of the closing face 3A, of the covering member 3 serves as the discharge part 31. The light emitting unit 6 is attached to the closing face 3A of the covering member 3. The light emitting unit 6 emits a laser beam to the circumferential surface of the photoreceptor drum 51 to form an electrostatic latent image on the circumferential surface in a state where the covering member 3 is at the close position. A sheet on which an image corresponding to the electrostatic latent image is formed by the image forming unit 5 is discharged to the discharge part 31 of the covering member 3 by the discharge roller pair 45.

In the image forming apparatus 1 configured above, a portion of the image forming unit 5 disposed in the apparatus body 2 is exposed to the outside by pivoting the covering member 3 from the close position to the open position. With the covering member 3 at the open position, a user can easily replace the image forming unit 5 or fix a jam to remove a jammed sheet. The light emitting unit 6 is attached not to the apparatus body 2 but to the covering member 3. As the covering member 3 pivots from the close position to the open position, the light emitting unit 6 moves away from the image forming unit 5 disposed in the apparatus body 2. Thus, a space for replacing the image forming unit 5 and fixing a jam needs not be provided in the apparatus body 2. This enables downsizing of the image forming apparatus 1.

[Structure for Attaching Light Emitting Unit to Covering Member]

Figure 4:
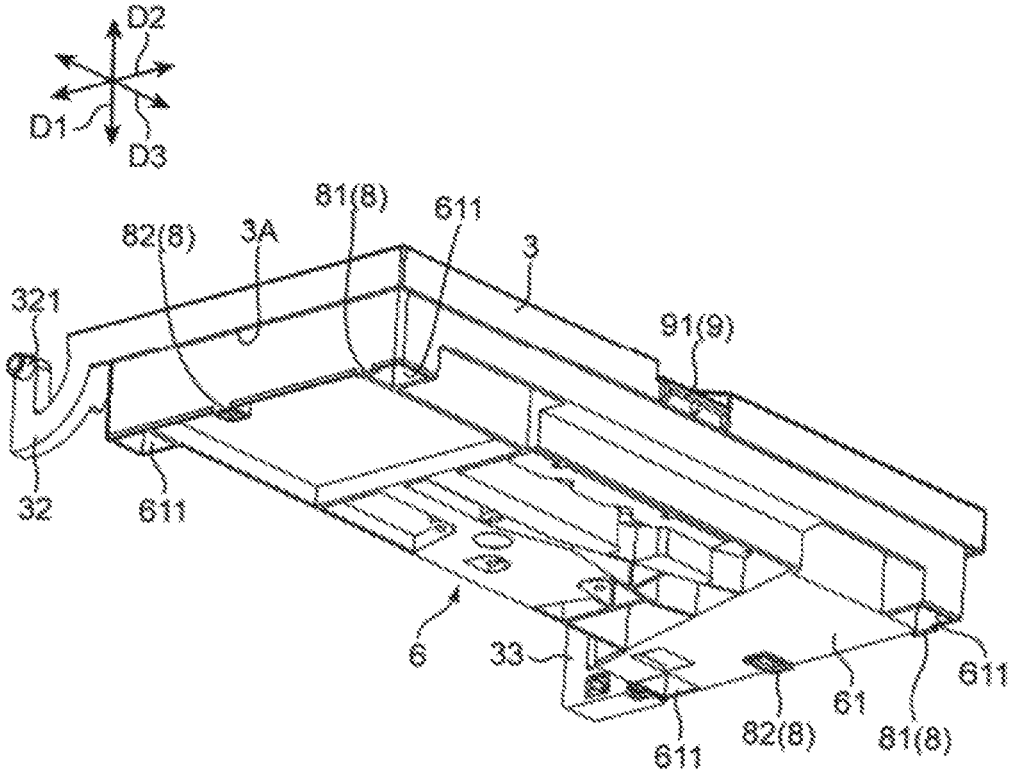
FIG. 4 is a perspective view illustrating a light emitting unit attached to the covering member.
Figure 5:
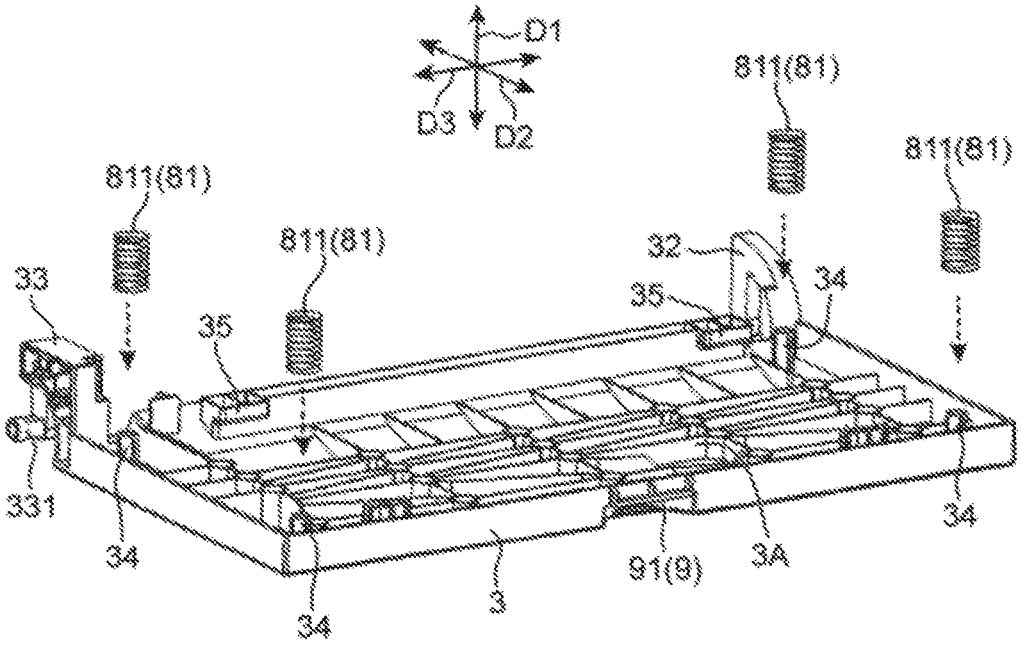
FIG. 5 is a view illustrating the light emitting unit being attached to the covering member.

A structure for attaching the light emitting unit 6 to the covering member 3 will be described with reference to FIGS. 4 to 7. FIG. 4 is a perspective view illustrating the light emitting unit 6 attached to the covering member 3. FIGS. 5 to 7 are views illustrating the light emitting unit 6 being attached to the covering member 3. In FIGS. 4, 5, and 7, a direction orthogonal to the closing face 3A, having a rectangular shape in a plan view, of the covering member 3 is "first direction D1", and directions parallel to the closing face 3A and orthogonal to each other are "second direction D2" and "third direction D3". In a state where the covering member 3 is at the close position, the first direction D1 is the vertical direction, the second direction D2 is the front-and-rear direction, and the third direction D3 is the right-and-left direction.

As illustrated in FIG. 5, the closing face 3A of the covering member 3 has projections 34 provided at four corners. A unit urging member 811 constituting a part of a first positioner 81 of a positioning mechanism 8, which will be described later, is attached to each projection 34. The unit urging member 811 is, for example, a coil spring. Two engaging hooks 35 are provided in a rear end of the covering member 3. There is a predetermined space along the third direction D3 between the two engaging hooks 35.

The optical housing 61 of the light emitting unit 6 has a rectangular shape in a plan view, corresponding to the closing face 3A of the covering member 3. The optical housing 61 has insert holes 611 (see FIGS. 4, 6A, 6B, and 7), each of which the projection 34 is inserted in, provided at four corners, and an engaging portion 612 (see FIG. 6A) which engages with the engaging hook 35.

Figure 6A:
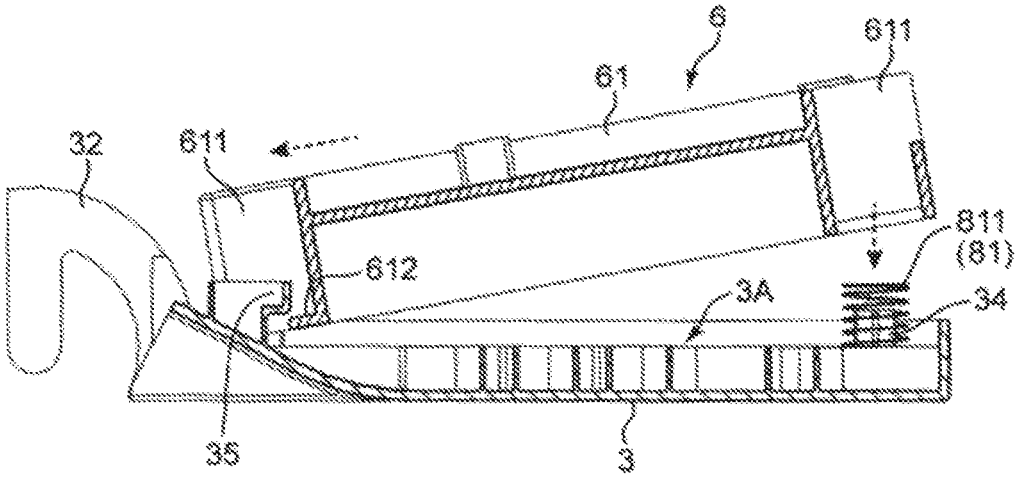
FIGS. 6A and 6B are views illustrating the light emitting unit being attached to the covering member.
Figure 6B:
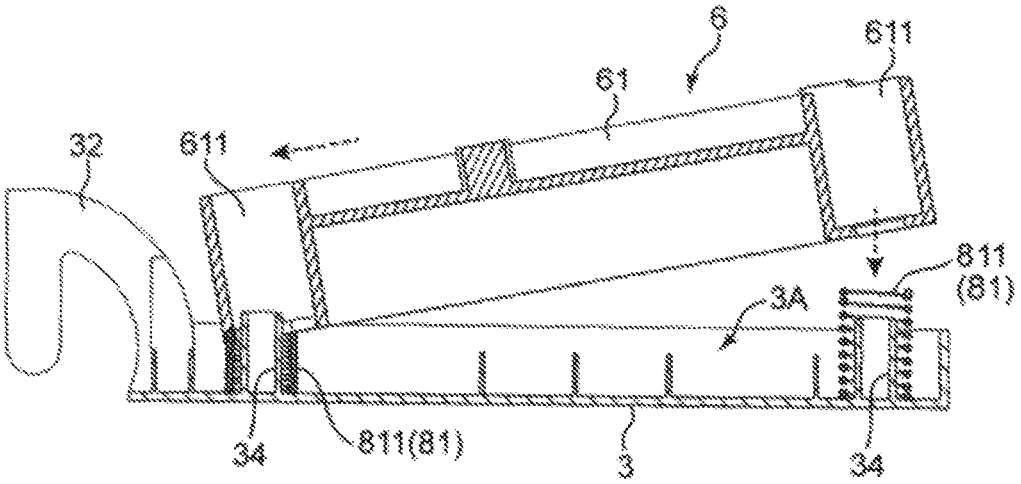
Figure 7:
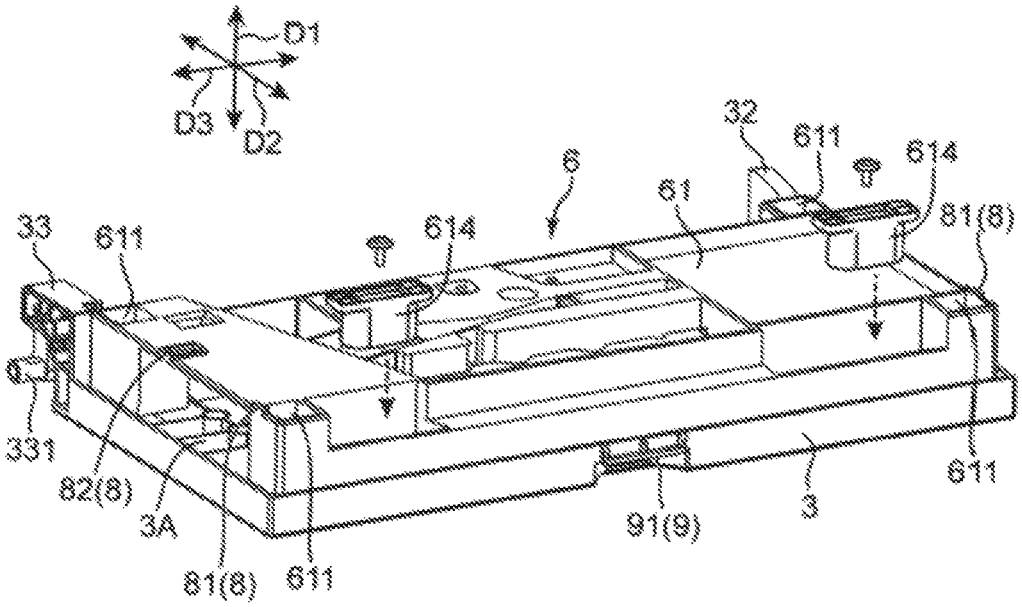
FIG. 7 is a view illustrating the light emitting unit being attached to the covering member.

The light emitting unit 6 is attached to the covering member 3, in which the unit urging members 811 are fit on the projections 34, by engaging the engaging portion 612 with the engaging hook 35 and pushing down a front end of the light emitting unit 6 toward the closing face 3A (see FIGS. 6A and 6B). Then, retaining members 614 are attached to the front end of the light emitting unit 6 (see FIG. 7). That is, the light emitting unit 6, urged by the unit urging members 811 toward the direction remote from the closing face 3A, is attached to the closing face 3A by engaging the engaging portion 612 with the engaging hook 35 and attaching the retaining members 614.

The light emitting unit 6 is attached to the closing face 3A of the covering member 3 but not fixed. The light emitting unit 6 is attached to the closing face 3A in a manner allowed to move in the first direction D1, the second direction D2, and the third direction D3, the first direction D1 being orthogonal to the closing face 3A, the second direction D2 and the third direction D3 being parallel to the closing face 3A and orthogonal to each other on the closing face 3A. That is, the light emitting unit 6 is attached to the closing face 3A in a manner allowed to move in a three-dimension defined by the first direction D1, the second direction D2, and the third direction D3. The light emitting unit 6 is movable relative to the closing face 3A by about several millimeters in the first direction D1, the second direction D2, and the third direction D3.

[Structure for Attaching Covering Member to Apparatus Body]

Figure 8:
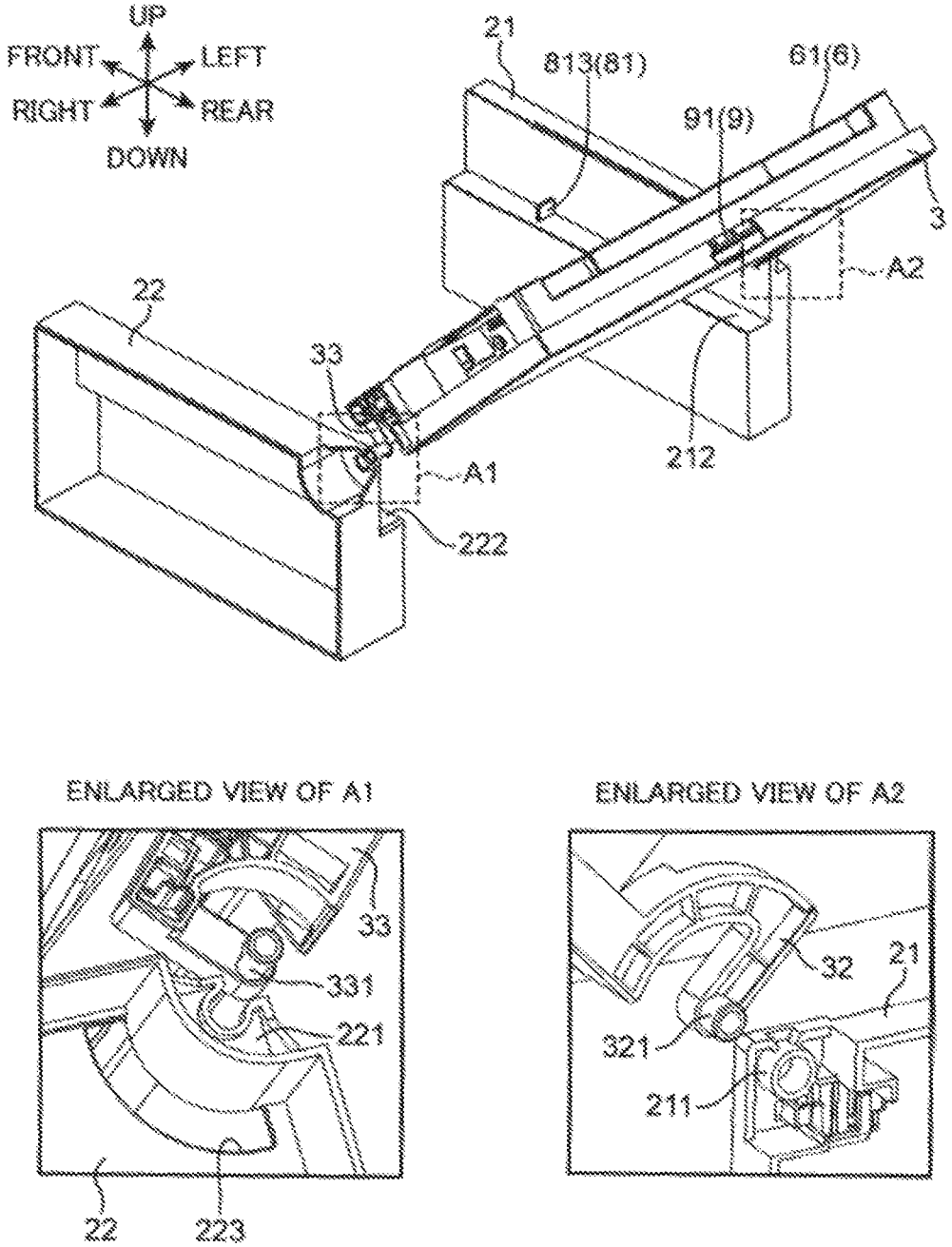
FIG. 8 is a perspective view including partially enlarged views, illustrating the covering member attached to an apparatus body.
Figure 9:
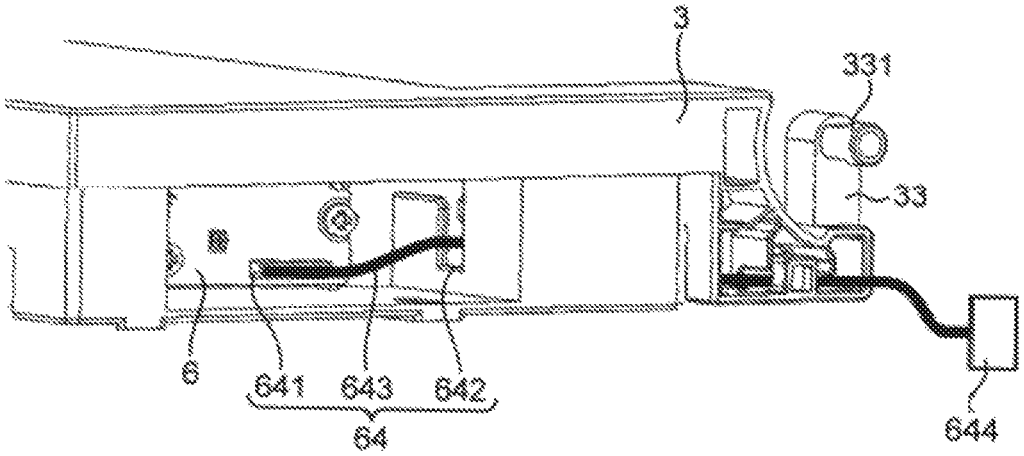
FIG. 9 is a perspective view illustrating wiring of the light emitting unit attached to the covering member.
Figure 10:
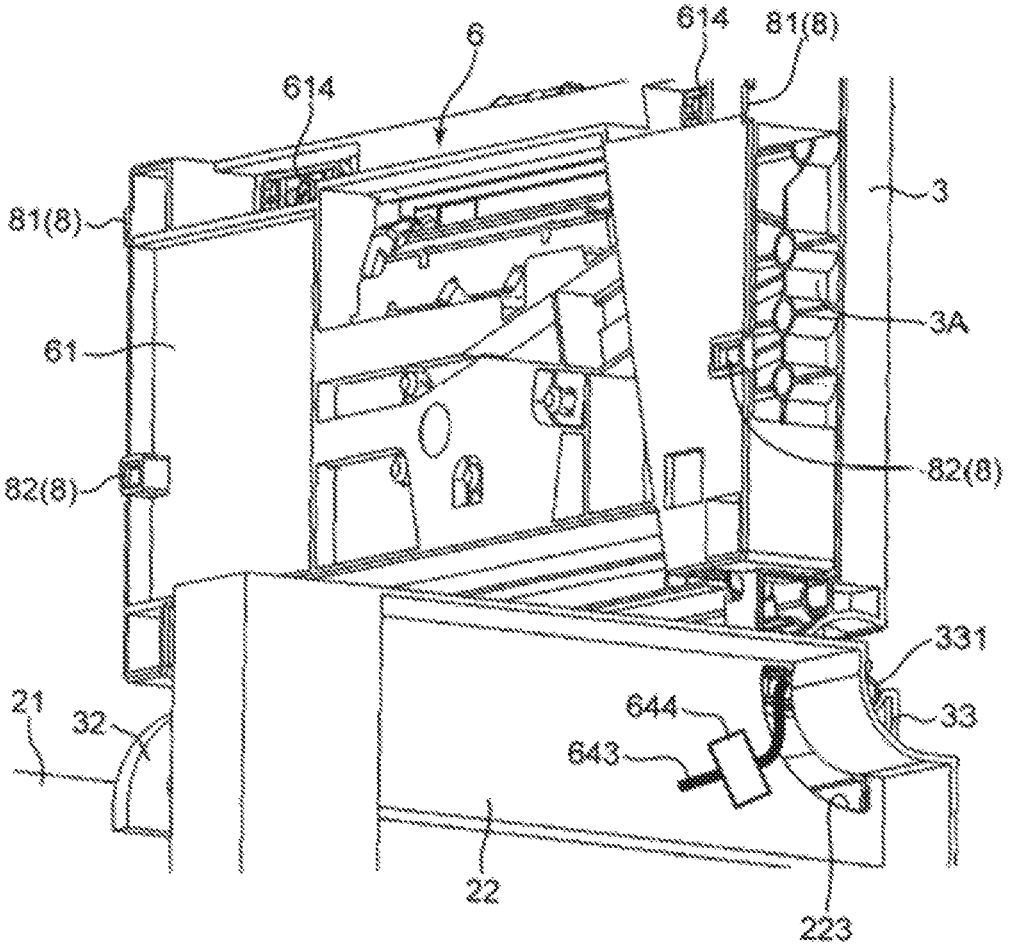
FIG. 10 is a perspective view illustrating a wiring cable, where the covering member is at an open position.
Figure 11:
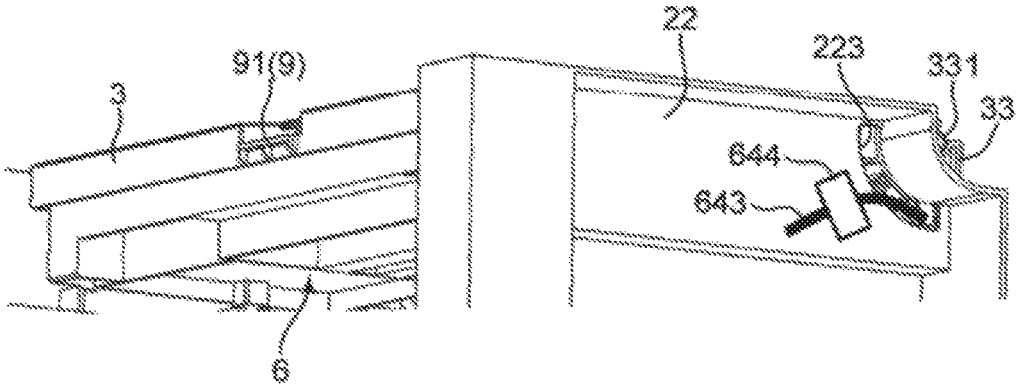
FIG. 11 is a perspective view illustrating the wiring cable, where the covering member is at a close position.
Figure 12:
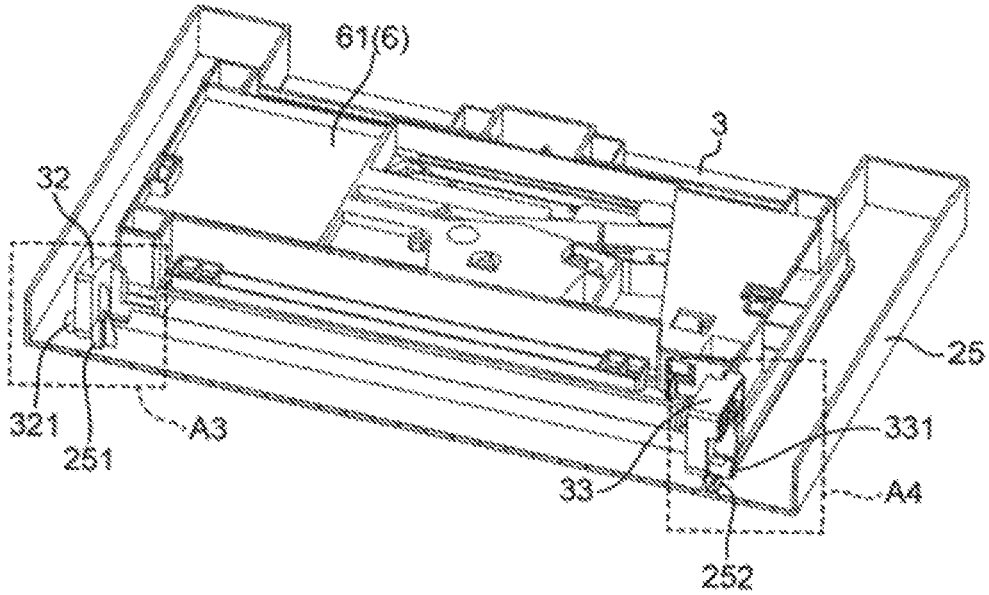
FIG. 12 is a perspective view including partially enlarged views, illustrating positional relationship between a top cover of the apparatus body and the covering member.
Figure 12:
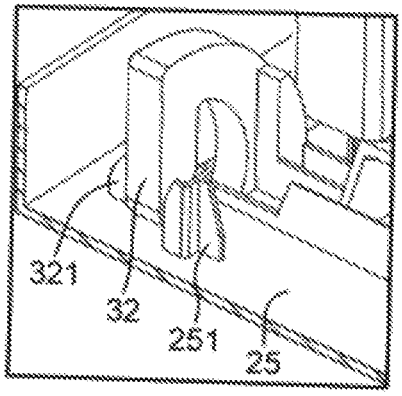
Figure 12:
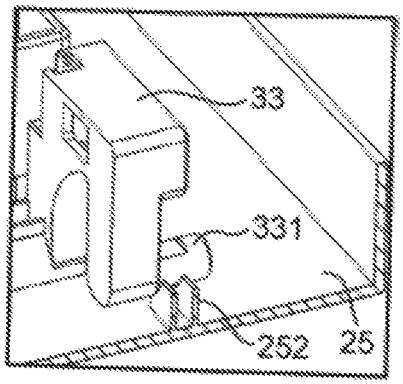

The covering member 3 with the light emitting unit 6 attached thereto is attached to the apparatus body 2. A structure for attaching the covering member 3 to the apparatus body 2 will be described with reference to FIGS. 8 to 12. FIG. 8 is a perspective view illustrating the covering member 3 attached to the apparatus body 2. FIG. 9 is a perspective view illustrating a wiring 64 of the light emitting unit 6 attached to the covering member 3. FIG. 10 is a perspective view illustrating a wiring cable 643, where the covering member 3 is at the open position. FIG. 11 is a perspective view illustrating the wiring cable 643, where the covering member 3 is at the close position. FIG. 12 is a perspective view illustrating positional relationship between the top cover 25 of the apparatus body 2 and the covering member 3.

As illustrated in FIG. 8, the first arm 32 of the covering member 3 includes a first pivot shaft 321, and the second arm 33 of the covering member 3 includes a second pivot shaft 331. Each of the first pivot shaft 321 and the second pivot shaft 331 is a pivot point of the covering member 3.

In the apparatus body 2, a first shaft receiver 211 is provided in an upper rear end of the first side wall 21, and a second shaft receiver 221 is provided in an upper rear end of the second side wall 22. The first shaft receiver 211 supports the first pivot shaft 321 and is formed in a circular shape. The second shaft receiver 221 supports the second pivot shaft 331 and is formed in a partially notched circular shape.

The covering member 3 is attached to the apparatus body 2 by inserting the first pivot shaft 321 in the first shaft receiver 211 and then pushing the second pivot shaft 331 into the second shaft receiver 221. Now, the covering member 3 is pivotally supported by the first shaft receiver 211 and the second shaft receiver 221 to pivot about the pivot points, which are the first pivot shaft 321 and the second pivot shaft 331, between the close position and the open position.

The light emitting unit 6 includes the wiring 64 that supplies driving power and a control signal for emitting a laser beam. The wiring 64 includes a wiring cable 643 for providing the driving power and transmitting the control signal, and a connector 641 to which the wiring cable 643 is connected. The driving power and the control signal are supplied to the light emitting unit 6 via the wiring cable 643 and the connector 641. The optical housing 61 is provided with a wiring route 642 along which the wiring cable 643 extending from the connector 641 runs. The wiring cable 643 runs through a notched portion 223 (see FIGS. 10 and 11) provided in the upper rear end of the second side wall 22 to be guided to the outside of the apparatus body 2 and is held by a wiring clamp 644 provided on an outer face of the second side wall 22. The wiring cable 643 routed as described above does not hinder pivoting of the covering member 3.

As illustrated in FIG. 12, a first rib 251 and a second rib 252 are provided to the top cover 25. The first rib 251 and the second rib 252 determine the relative position of the covering member 3 to the top cover 25, namely, the relative position of the covering member 3 to the apparatus body 2. The first rib 251 is provided on the top cover 25 to be near the first arm 32, and the second rib 252 is provided on the top cover 25 to be near the second arm 33.

[Positioning Mechanism]

Figure 13:
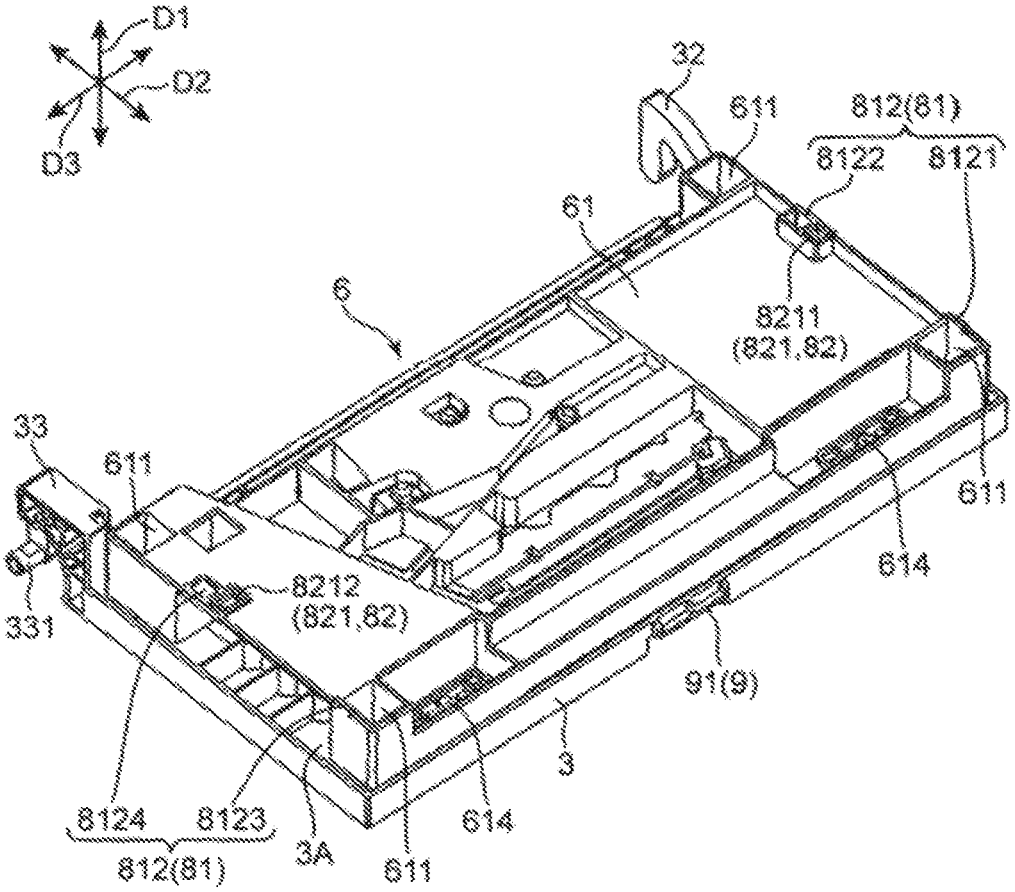
FIG. 13 is a perspective view illustrating the light emitting unit attached to the covering member and a positioning mechanism provided to the light emitting unit.
Figure 14A:
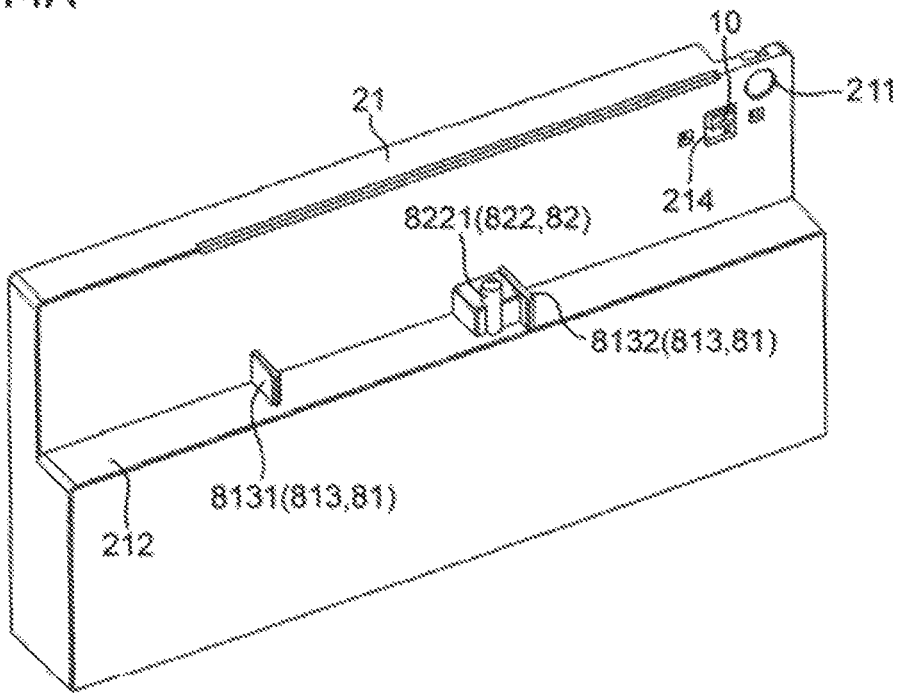
FIGS. 14A and 14B are perspective views illustrating a first side wall and a second side wall of the apparatus body, and a positioning mechanisms provided to each of the side walls.
Figure 14B:
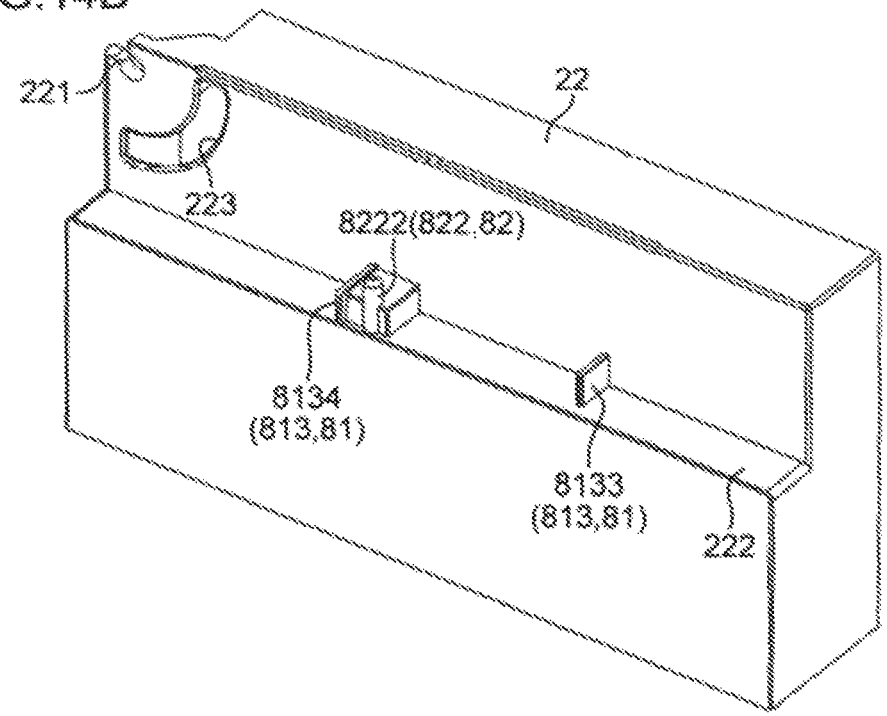
Figure 15A:
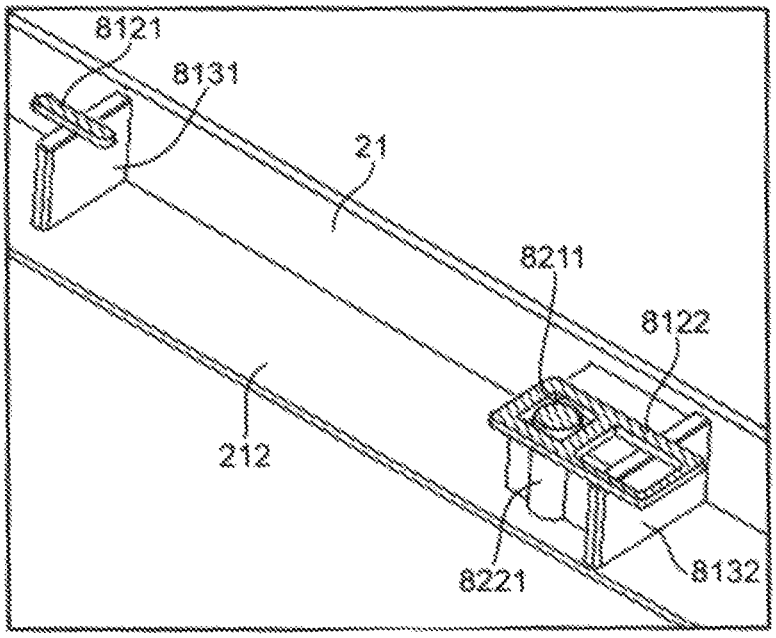
FIGS. 15A and 15B illustrate the light emitting unit positioned to the apparatus body by the positioning mechanisms.
Figure 15B:
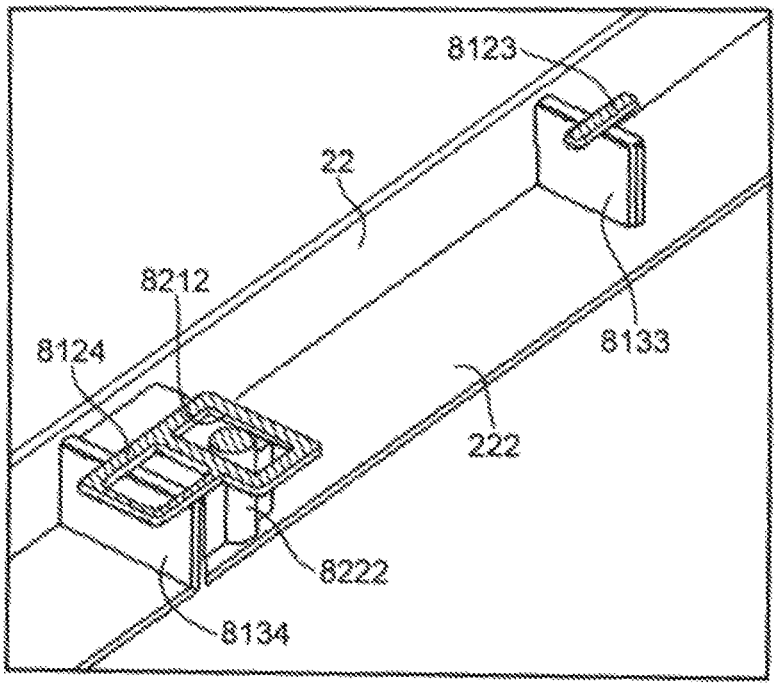

As illustrated in FIGS. 13 to 15B, the image forming apparatus 1 according to the embodiment includes a positioning mechanism 8 for positioning the light emitting unit 6 to the apparatus body 2. FIG. 13 is a perspective view illustrating the light emitting unit 6 attached to the covering member 3 and the positioning mechanism 8 provided to the light emitting unit 6. FIGS. 14A and 14B are perspective views illustrating the first side wall 21 and the second side wall 22 of the apparatus body 2, and the positioning mechanisms 8 provided in each of the first side wall 21 and the second side wall 22. FIGS. 15A and 15B illustrate the light emitting unit 6 positioned to the apparatus body 2 by the positioning mechanisms 8.

The positioning mechanism 8 is for positioning the light emitting unit 6 to the apparatus body 2, in a state where the covering member 3 is at the close position, regarding the first direction D1, the second direction D2, and the third direction D3, the first direction D1 being orthogonal to the closing face 3A, the second direction D2 and the third direction D3 being parallel to the closing face 3A and orthogonal to each other on the closing face 3A.

As described above, the light emitting unit 6 is attached to the closing face 3A of the covering member 3 in a manner allowed to move in the three-dimension defined by the first direction D1, the second direction D2, and the third direction D3. Pivoting of the covering member 3 from the open position to the close position will now be described. In this case, the light emitting unit 6 moves relative to the closing face 3A of the covering member 3 in a three-dimensional manner to be positioned to the apparatus body 2 by the positioning mechanism 8. With the covering member 3 at the close position, the light emitting unit 6 is positioned to the apparatus body 2 with a high accuracy. In the apparatus body 2 where the covering member 3 is at the close position, the light emitting unit 6 and the image forming unit 5 are in a predetermined suitable positional relationship. As a result, a suitable electrostatic latent image can be formed on the circumferential surface of the photoreceptor drum 51 by the light emitting unit 6, and a suitable image corresponding to the electrostatic latent image can be formed on a sheet.

The positioning mechanism 8 includes a first positioner 81 and a second positioner 82. The first positioner 81 positions the light emitting unit 6 to the apparatus body 2 regarding the first direction D1. The second positioner 82 positions the light emitting unit 6 to the apparatus body 2 regarding the second direction D2 and the third direction D3. As described above, with the covering member 3 at the close position, the first direction D1 is the vertical direction, the second direction D2 is the front-and-rear direction, and the third direction D3 is the right-and-left direction.

The first positioner 81 includes the unit urging members 811 attached to the closing face 3A of the covering member 3, a contact portion 812 provided to the light emitting unit 6, and a positioning protrusion 813 provided to the apparatus body 2.

The unit urging members 811 are, as described above, attached to the projections 34 provided on the closing face 3A (see FIG. 5). The unit urging members 811 urge the light emitting unit 6 toward the direction remote from the closing face 3A (one of directions along the first direction D1).

As illustrated in FIG. 13, the contact portion 812 includes a first front contact portion 8121, a first rear contact portion 8122, a second front contact portion 8123, and a second rear contact portion 8124, where the first front contact portion 8121 and the first rear contact portion 8122 are provided in a left end portion of the optical housing 61 and the second front contact portion 8123 and the second rear contact portion 8124 are provided in a right end portion of the optical housing 61. The first front contact portion 8121 and the first rear contact portion 8122 in the left end portion of the optical housing 61 are separated from each other along the front-and-rear direction. The first front contact portion 8121 is further in the front side than the first rear contact portion 8122. Similarly, the second front contact portion 8123 and the second rear contact portion 8124 in the right end portion of the optical housing 61 are separated by a predetermined distance along the front-and-rear direction. The second front contact portion 8123 is further in the front side than the second rear contact portion 8124.

As illustrated in FIGS. 14A and 14B, the positioning protrusion 813 includes a first front protrusion 8131, a first rear protrusion 8132, a second front protrusion 8133, and a second rear protrusion 8134, where the first front protrusion 8131 and the first rear protrusion 8132 are provided on the first side wall 21 and the second front protrusion 8133 and the second rear protrusion 8134 are provided on the second side wall 22. The first front protrusion 8131 and the first rear protrusion 8132 are disposed on a top face of a first step 212 provided to the first side wall 21 with a predetermined distance therebetween along the front-and-rear direction. The first front protrusion 8131 is further in the front side than the first rear protrusion 8132. Similarly, the second front protrusion 8133 and the second rear protrusion 8134 are disposed on a top face of a second step 222 provided to the second side wall 22 with a predetermined distance therebetween along the front-and-rear direction. The second front protrusion 8133 is further in the front side than the second rear protrusion 8134.

Pivoting of the covering member 3 to the close position will now be described. In this case, with the unit urging members 811 urging the light emitting unit 6, the contact portion 812 provided to the optical housing 61 is in contact with the positioning protrusion 813 provided to the apparatus body 2. In more detail, the first front contact portion 8121 is in contact with the first front protrusion 8131, the first rear contact portion 8122 is in contact with the first rear protrusion 8132, the second front contact portion 8123 is in contact with the second front protrusion 8133, and the second rear contact portion 8124 is in contact with the second rear protrusion 8134. The light emitting unit 6 is thereby positioned to the apparatus body 2 regarding the first direction D1 orthogonal to the closing face 3A of the covering member 3.

The second positioner 82 includes a unit insertion portion 821 provided to the light emitting unit 6, and a body insertion portion 822 provided to the apparatus body 2.

As illustrated in FIG. 13, the unit insertion portion 821 has a first insertion hole 8211 provided in a left end portion of the optical housing 61, and a second insertion hole 8212 provided in the right end portion of the optical housing 61. The first insertion hole 8211 is provided in the left end portion of the optical housing 61 to be adjacent to the first rear contact portion 8122. The first insertion hole 8211 has a size allowing a first insertion pin 8221, which will be described later, to be inserted therein. The first insertion hole 8211 has such a size that restricts displacement of the first insertion pin 8221 inserted in the first insertion hole 8211. The second insertion hole 8212 is provided in the right end portion of the optical housing 61 to be adjacent to the second rear contact portion 8124. The second insertion hole 8212 is a hole in which a second insertion pin 8222, which will be described later, is inserted. The second insertion hole 8212 is an elongate hole extending in the right-and-left direction (the third direction D3) to allow a displacement of the second insertion pin 8222 inserted in the second insertion hole 8212 along the right-and-left direction.

As illustrated in FIGS. 14A and 14B, the body insertion portion 822 includes the first insertion pin 8221 provided on the first side wall 21, and the second insertion pin 8222 provided on the second side wall 22. The first insertion pin 8221 is provided on the top face of the first step 212 of the first side wall 21 to be adjacent to the first rear protrusion 8132. The second insertion pin 8222 is provided on the top face of the second step 222 of the second side wall 22 to be adjacent to the second rear protrusion 8134.

Pivoting of the covering member 3 to the close position will now be described. In this case, the body insertion portion 822 provided to the apparatus body 2 fits in the unit insertion portion 821 provided to the optical housing 61. In more detail, the first insertion pin 8221 is inserted and fits in the first insertion hole 8211, and the second insertion pin 8222 is inserted and fits in the second insertion hole 8212. The light emitting unit 6 is thereby positioned to the apparatus body 2 regarding the second direction D2 and the third direction D3 parallel to the closing face 3A of the covering member 3.

[Locking Mechanism]

Figure 16A:
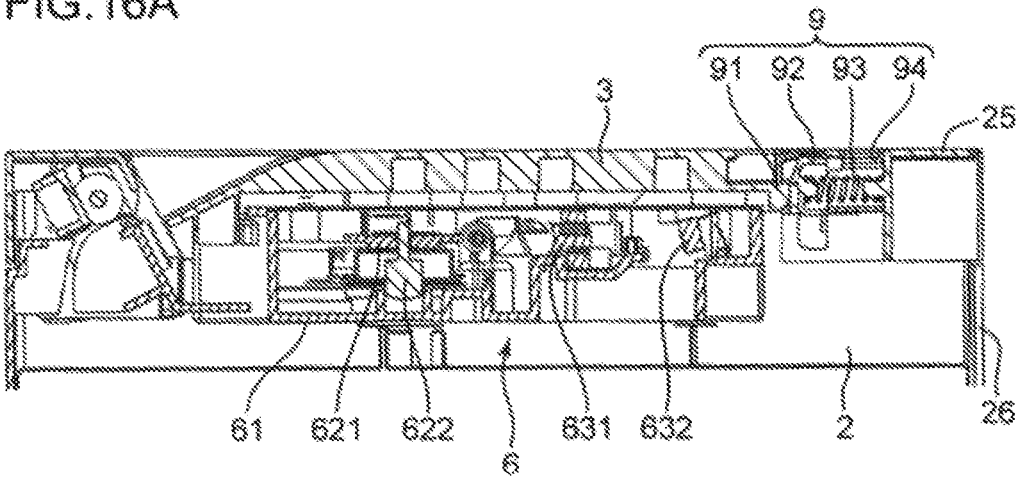
FIGS. 16A and 16B are cross-sectional views of the image forming apparatus, illustrating a locking mechanism.
Figure 16B:
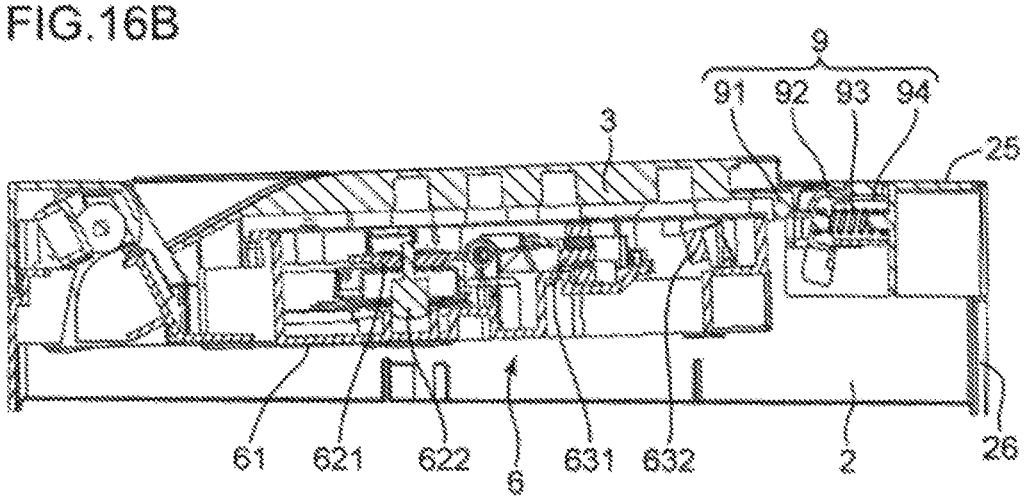
Figure 17A:
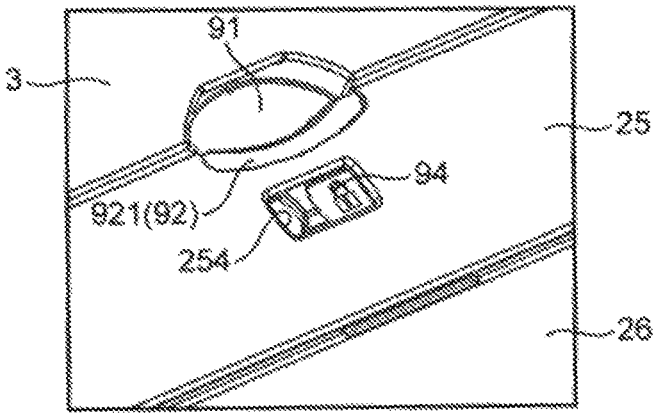
FIGS. 17A, 17B, and 17C illustrate the covering member locked by the locking mechanism.
Figure 17B:
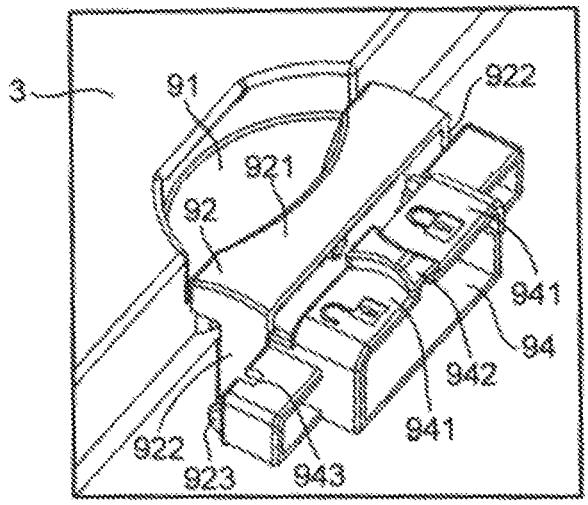
Figure 17C:
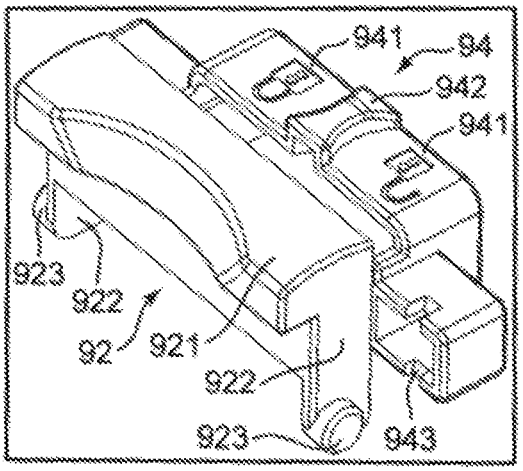
Figure 18A:
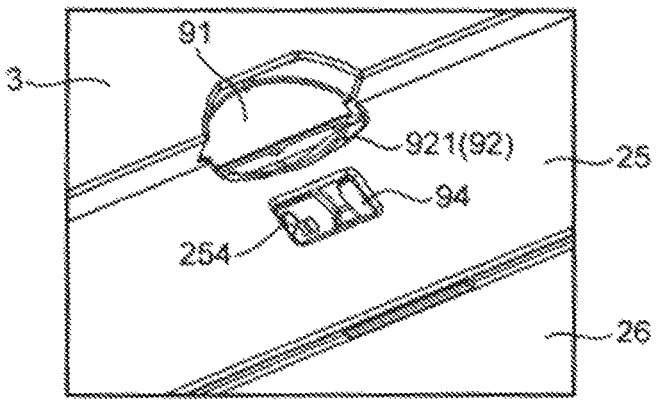
FIGS. 18A, 18B, and 18C illustrate the covering member unlocked by the locking mechanism.
Figure 18B:
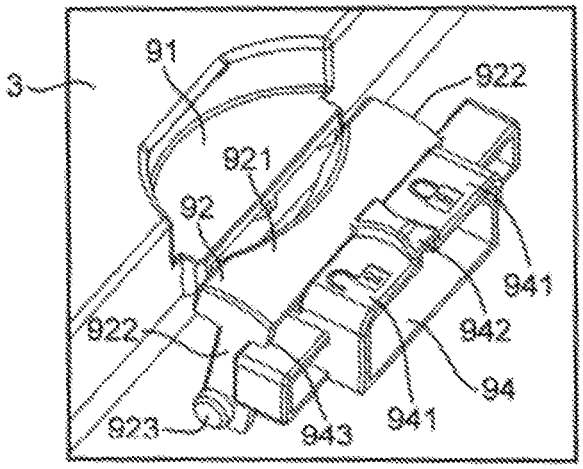
Figure 18C:
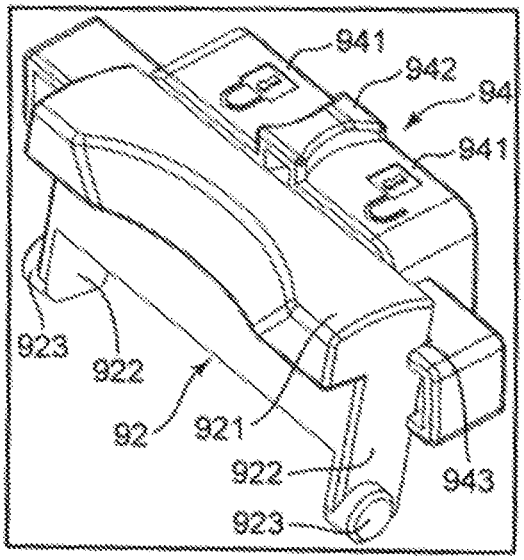
Figure 19:
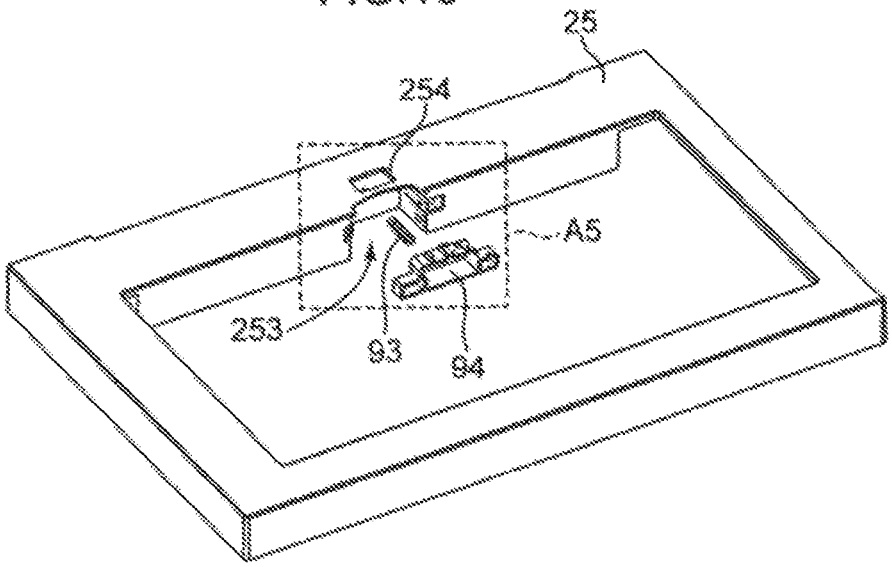
FIG. 19 is a view including a partially enlarged view, illustrating a portion of the locking mechanism being attached to the top cover.
Figure 19:
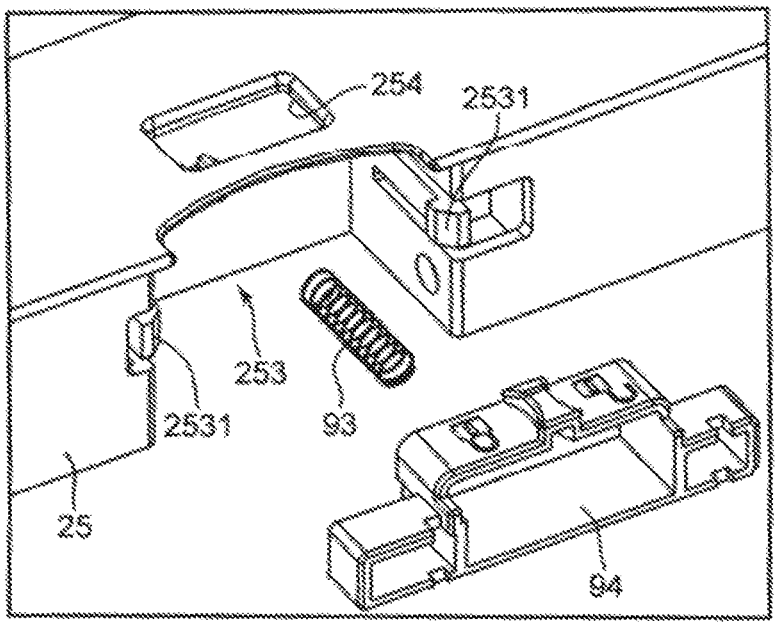
Figure 20:
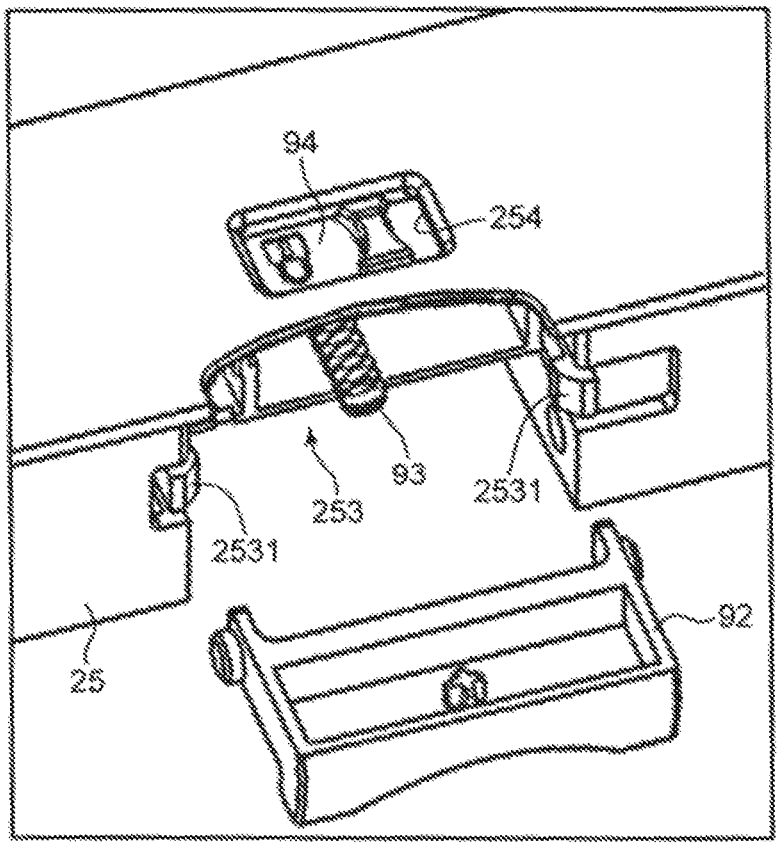
FIG. 20 is a view illustrating a portion of the locking mechanism being attached to the top cover.
Figure 21:
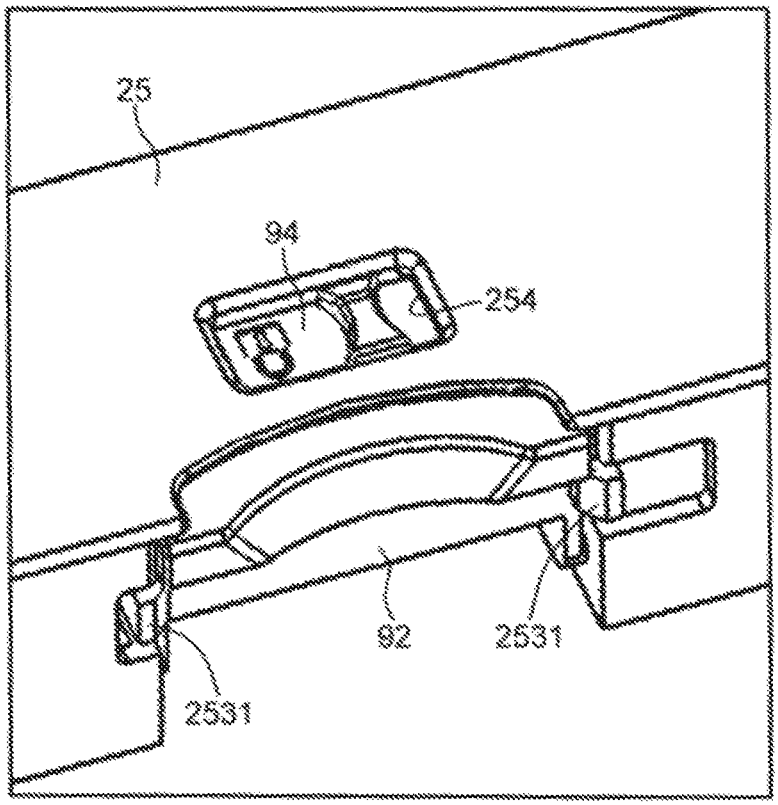
FIG. 21 is a view illustrating a portion of the locking mechanism being attached to the top cover.

As illustrated in FIGS. 16A to 21, the image forming apparatus 1 according to the embodiment further includes a locking mechanism 9. FIGS. 16A and 16B are cross-sectional views of the image forming apparatus 1, illustrating the locking mechanism 9. FIGS. 17A to 17C illustrate the covering member 3 locked by the locking mechanism 9. FIGS. 18A to 18C illustrate the covering member 3 unlocked by the locking mechanism 9. FIGS. 19 to 21 are views illustrating a portion of the locking mechanism 9 being attached to the top cover 25.

The locking mechanism 9 can keep the covering member 3 at the close position and release the covering member 3 from the close position. The locking mechanism 9 includes a lock-engaging unit 91, a locking member 92, a lock-urging member 93, and a lock-switching member 94.

The lock-engaging unit 91 is provided in a middle of the front end portion of the covering member 3. The locking member 92 is provided in a locking region 253 of the top cover 25 of the apparatus body 2. The locking member 92 is able to engage with the lock-engaging unit 91. The locking region 253 is provided in a front middle portion of the top cover 25 and includes a lock-engaging hook 2531. When the covering member 3 is at the close position, the locking region 253 is further in the front side than the lock-engaging unit 91. The locking member 92 includes an engaging projection 921 that engages with the lock-engaging unit 91, a pair of side plates 922, and a pivot shafts 923 extending in the right-and-left direction.

With the locking member 92 attached to the locking region 253, the pair of side plates 922 engages with the lock-engaging hook 2531 and the locking member 92 is allowed to pivot about the pivot shafts 923 in the front-and-rear direction. By pivoting the locking member 92 about the pivot shafts 923 in the rear direction to engage the engaging projection 921 with the lock-engaging unit 91, the covering member 3 is kept at the close position. On the other hand, by pivoting the locking member 92 about the pivot shafts 923 in the front direction to disengage the engaging projection 921 from the lock-engaging unit 91, the covering member 3 is allowed to pivot from the close position to the open position.

The lock-urging member 93 attached to the locking region 253 urges the locking member 92 to cause the locking member 92 to engage with the lock-engaging unit 91. The lock-urging member 93 is, for example, a coil spring.

The lock-switching member 94 is attached to the locking region 253 in a manner allowed to slide along the right-and-left direction between a locked position and an unlocked position. The engaging state of the locking member 92 and the lock-engaging unit 91 is switched by the lock-switching member 94. The lock-switching member 94 attached to the locking region 253 is further in the front side than the locking member 92. A user operates the lock-switching member 94. That is, the user operates the lock-switching member 94 to switch the engaging state of the locking member 92 and the lock-engaging unit 91. The locking member 92 engages with the lock-engaging unit 91 when the lock-switching member 94 is at the locked position. On the other hand, the locking member 92 can disengage from the lock-engaging unit 91 when the lock-switching member 94 is at the unlocked position.

The lock-switching member 94 includes a lock/unlock indicator 941, a handle 942, and a pair of engagement groove pairs 943. The lock/unlock indicator 941 informs the user of whether the lock-switching member 94 is at the locked position or the unlocked position. A window 254 is provided in the locking region 253. The lock-switching member 94 is attached to the locking region 253 such that the lock/unlock indicator 941 is exposed through the window 254. The user can see the lock/unlock indicator 941 exposed through the window 254 to recognize the position of the lock-switching member 94, that is, to see the engaging state of the locking member 92 and the lock-engaging unit 91.

The handle 942 provided on the lock/unlock indicator 941 is operated by the user. That is, the user can operate the handle 942 to switch the engaging state of the locking member 92 and the lock-engaging unit 91 and at the same time check the position of the lock/unlock indicator 941 exposed through the window 254

The pair of engagement groove pairs 943 are provided in right and left ends of the lock-switching member 94 and can engage with the pair of side plates 922 of the locking member 92. Pivoting of the locking member 92 about the pivot shaft 923 is controlled by the engaging state of the pair of engagement groove pairs 943 and the pair of side plates 922. That is, when the pair of engagement groove pairs 943 and the pair of side plates 922 are in such a positional relationship of being mutually shifted regarding the right-and-left direction that disallows engagement, pivoting of the locking member 92 in the front direction is restricted. This keeps engagement of the engaging projection 921 with the lock-engaging unit 91, thereby keeping the covering member 3 at the close position. On the other hand, when the pair of engagement groove pairs 943 and the pair of side plates 922 are in such a positional relationship of matching regarding the right-and-left direction that allows engagement, pivoting of the locking member 92 in the front direction is allowed. This enables disengagement of the engaging projection 921 from the lock-engaging unit 91.

The positional relationship between the pair of engagement groove pairs 943 and the pair of side plates 922 will be described in detail with reference to FIGS. 17A to 18C. With the lock-switching member 94 positioned at the locked position as illustrated in FIGS. 17A to 17C, the pair of engagement groove pairs 943 and the pair of side plates 922 are mutually shifted regarding the right-and-left direction and cannot engage with each other. This disallows pivoting of the locking member 92 in the front direction. This keeps engagement of the engaging projection 921 with the lock-engaging unit 91, thereby keeping the covering member 3 at the close position.

As illustrated in FIGS. 18A to 18C, with the lock-switching member 94 positioned at the unlocked position, the pair of engagement groove pairs 943 and the pair of side plates 922 are at matched positions regarding the right-and-left direction and can engage with each other. This allows pivoting of the locking member 92 in the front direction. This enables disengagement of the engaging projection 921 from the lock-engaging unit 91.

As described above, moving the lock-switching member 94 attached to the locking region 253 to the locked position causes the lock-engaging unit 91 of the covering member 3 to engage with the locking member 92 in the locking region 253. This keeps the covering member 3 at the close position. As a result, in the apparatus body 2 where the covering member 3 is at the close position, the light emitting unit 6 and the image forming unit 5 can be kept in a predetermined suitable positional relationship. On the other hand, moving the lock-switching member 94 to the unlocked position allows disengagement of the lock-engaging unit 91 from the locking member 92. This allows pivoting of the covering member 3 from the close position to the open position.

[Structure for Keeping Covering Member at Open Position]

Figure 22:
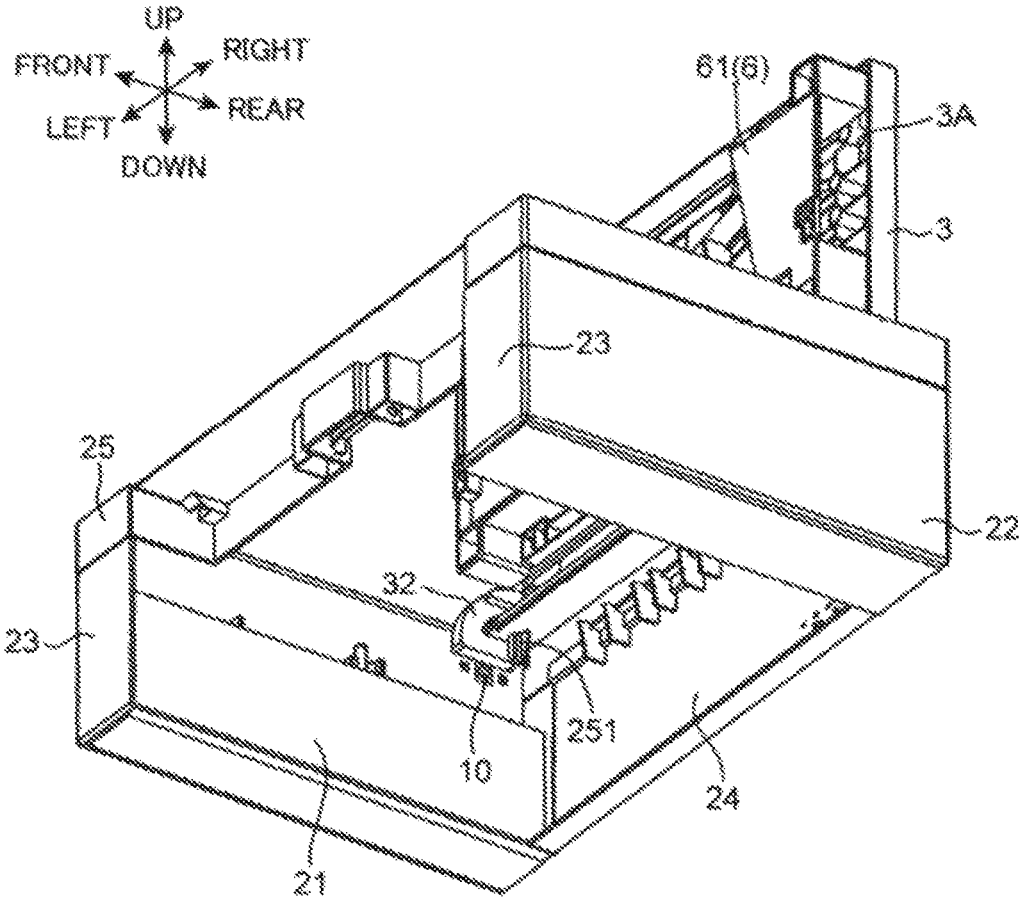
FIG. 22 is a perspective view of the image forming apparatus, illustrating an open position keeping member.
Figure 23A:
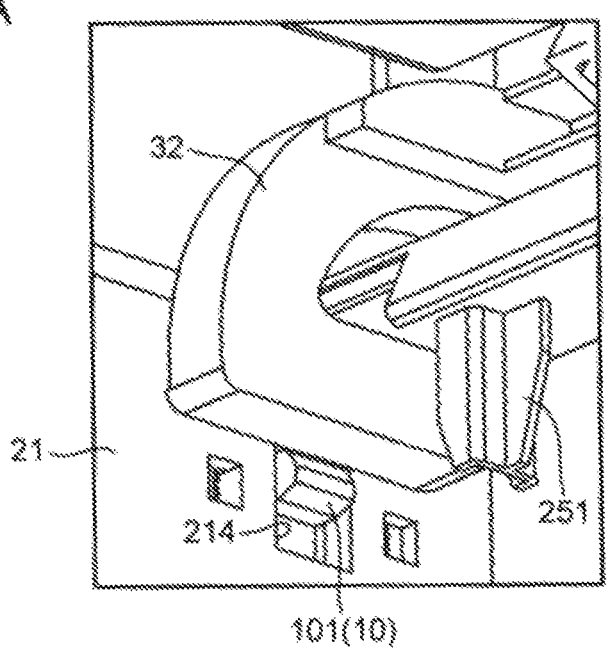
FIGS. 23A and 23B are enlarged perspective views illustrating the open position keeping member.
Figure 23B:
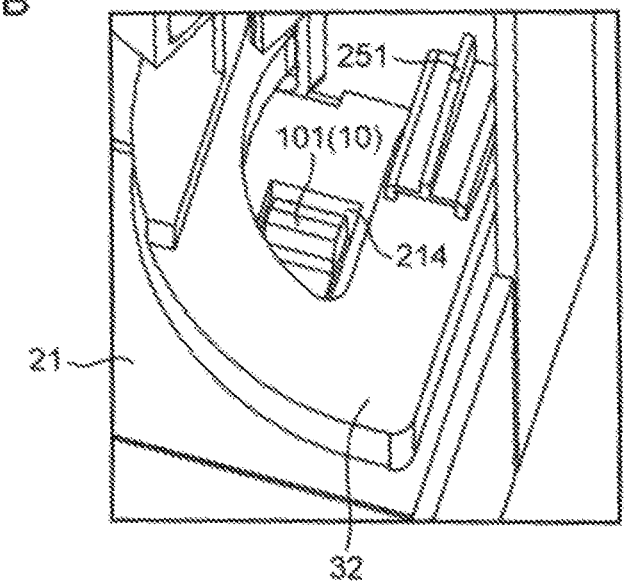
Figure 24A:
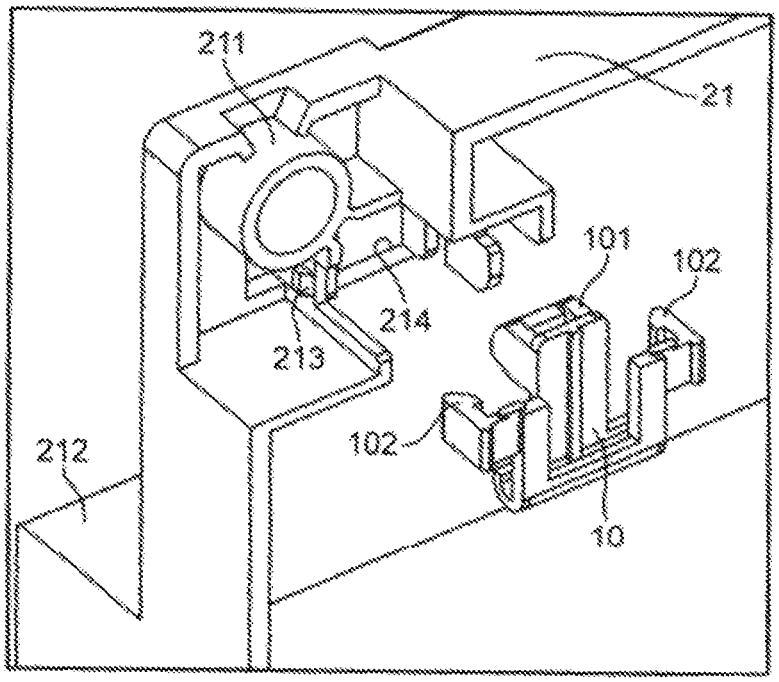
FIGS. 24A and 24B are views illustrating the open position keeping member being attached to the first side wall.
Figure 24B:
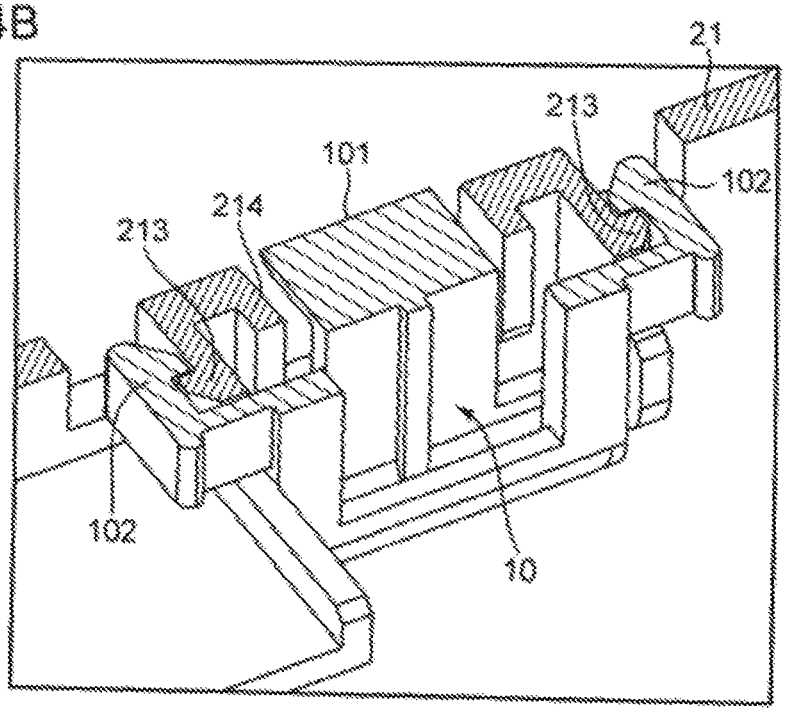

As illustrated in FIGS. 22 to 24B, the image forming apparatus 1 according to the embodiment further includes an open position keeping member 10. FIG. 22 is a perspective view of the image forming apparatus 1, illustrating the open position keeping member 10. FIGS. 23A and 23B are enlarged perspective views illustrating the open position keeping member 10. FIGS. 24A and 24B are views illustrating the open position keeping member 10 being attached to the first side wall 21.

The open position keeping member 10 keeps the covering member 3 at the open position. The open position keeping member 10 is attached to the upper rear end of the first side wall 21 of the apparatus body 2. As illustrated in FIGS. 24A and 24B, a body engaging portion 213 and an opening 214 are provided in the upper rear end of the first side wall 21 to which the open position keeping member 10 is attached.

The open position keeping member 10 includes a stopper projection 101 and a stopper engaging portion 102. The open position keeping member 10 is attached to the upper rear end of the first side wall 21 by the stopper engaging portion 102 engaging with the body engaging portion 213. With the open position keeping member 10 in this state, the stopper projection 101 can protrude into or retract from the internal space 2A of the apparatus body 2 through the opening 214.

As illustrated in FIGS. 23A and 23B, the stopper projection 101 protrudes into the internal space 2A through the opening 214 with the covering member 3 at the open position or the close position. With the covering member 3 at the open position, the stopper projection 101 protrudes into the internal space 2A through the opening 214 to support the first arm 32 from below. This keeps the covering member 3 at the open position. With the covering member 3 at the close position, the stopper projection 101 is protruding into the internal space 2A through the opening 214 but not in contact with the first arm 32. When the covering member 3 is in a midway of pivoting between the open position and the close position, the stopper projection 101 comes into contact with a side face of the first arm 32 to be retracted through the opening 214 to the outer side.

In this aspect, the open position keeping member 10 can keep the covering member 3 at the open position. With the covering member 3 at the open position, the user can further easily replace the image forming unit 5 or fix a jam.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. An image forming apparatus comprising:

an apparatus body including an internal space, and an opening through which the internal space is exposed;

an image forming unit disposed in the internal space, including an image carrier having a circumferential surface on which an electrostatic latent image is carried, and configured to form an image on a sheet, the image corresponding to the electrostatic latent image;

a covering member having a closing face capable of closing the opening of the apparatus body from above, the covering member being pivotally supported on the apparatus body to pivot between a close position where the closing face closes the internal space and an open position where a portion of the image forming unit is exposed to an outside;

a light emitting unit attached to the closing face of the covering member, and configured to emit a laser beam to scan the circumferential surface of the image carrier with the laser beam along a main-scan direction to form the electrostatic latent image on the circumferential surface in a state where the covering member is at the close position; and a positioning mechanism configured to position the light emitting unit to the apparatus body, in the state where the covering member is at the close position, regarding a first direction, a second direction, and a third direction, the first direction being orthogonal to the closing face, the second direction and the third direction being orthogonal to each other on the closing face, wherein the light emitting unit is attached to the closing face in a manner allowed to move in the first direction, the second direction, and the third direction so that when the covering member has pivoted from the open position to the close position, the light emitting unit is positioned to the apparatus body by the positioning mechanism, the positioning mechanism includes a first positioner configured to position the light emitting unit to the apparatus body regarding the first direction, and the first positioner includes:

a unit urging member attached to the closing face, and configured to urge the light emitting unit toward a direction remote from the closing face along the first direction, the first contact portions respectively provided in a first end portion and a second end portion of the light emitting unit, the second contact portions respectively provided in positions that are separated from the first contact portions by a predetermined distance along the second direction, and first and second positioning protrusions provided to the apparatus body, the first and second contact portions being in contact with the positioning protrusions respectively with the light emitting unit urged by the unit urging member when the covering member is at the close position.

2. The image forming apparatus according to claim 1, wherein the positioning mechanism includes a second positioner configured to position the light emitting unit to the apparatus body regarding the second direction and the third direction, and the second positioner includes a unit insertion portion provided to the light emitting unit, and a body insertion portion provided to the apparatus body and configured to fit in the unit insertion portion when the covering member is at the close position.

3. The image forming apparatus according to claim 1, further comprising:

a locking mechanism configured to keep the covering member at the close position and release the covering member from close position, wherein the locking mechanism includes a lock-engaging unit provided to the covering member, a locking member provided to the apparatus body and capable of engaging with the lock-engaging unit, a lock-urging member configured to urge the locking member to cause the locking member to engage with the lock-engaging unit, and a lock-switching member attached to the apparatus body so as to slide between a locked position where the locking member engages with the lock-engaging unit and an unlocked position where the locking member is disengaged from the lock-engaging unit.

4. An image forming apparatus comprising:

an apparatus body including an internal space, and a rectangular opening through which the internal space is exposed;

an image forming unit disposed in the internal space, including an image carrier having a circumferential surface on which an electrostatic latent image is carried, and configured to form an image on a sheet, the image corresponding to the electrostatic latent image;

a covering member having a rectangular closing face capable of closing the opening of the apparatus body from above, the covering member being pivotally supported on the apparatus body to pivot between a close position where the closing face closes the internal space and an open position where a portion of the image forming unit is exposed to an outside;

a light emitting unit attached to the closing face of the covering member, and configured to emit a laser beam to scan the circumferential surface of the image carrier with the laser beam along a main-scan direction to form the electrostatic latent image on the circumferential surface in a state where the covering member is at the close position; wherein the light emitting unit includes an optical housing and a light deflector and an imaging system housed in the optical housing, the optical housing has a rectangular shape including four corners that are disposed respectively at positions corresponding to four corners of the rectangular closing face, the first contact portions and the second contact portions are provided at a first end portion and a second end portion of the optical housing, the first end portion and the second end portion facing each other, the first contact portions and the second contact portions being separated from each other by a predetermined distance, and being in contact with portions of the apparatus body to position the light emitting unit with respect to the apparatus body in a first direction orthogonal to the closing face.

* * * * *